US008350481B1

(12) United States Patent
Larsen

(10) Patent No.: US 8,350,481 B1
(45) Date of Patent: Jan. 8, 2013

(54) METHOD OF CREATING A LIGHT EFFECT

(76) Inventor: Harold Larsen, Bay City, MI (US)

( * ) Notice: Subject to any disclaimer, the term of this patent is extended or adjusted under 35 U.S.C. 154(b) by 397 days.

(21) Appl. No.: 12/802,019

(22) Filed: May 27, 2010

(51) Int. Cl.
*H05B 37/00* (2006.01)

(52) U.S. Cl. ..... 315/149; 315/39; 362/235

(58) Field of Classification Search ..... 315/39, 315/149; 362/227, 235
See application file for complete search history.

(56) References Cited

U.S. PATENT DOCUMENTS

| | | | | |
|---|---|---|---|---|
| 6,285,134 | B1 * | 9/2001 | Yano et al. | 315/149 |
| 2006/0238717 | A1 * | 10/2006 | Maximus et al. | 353/30 |
| 2009/0124335 | A1 * | 5/2009 | Watkins et al. | 463/20 |
| 2011/0261427 | A1 * | 10/2011 | Hart et al. | 359/22 |
| 2012/0007899 | A1 * | 1/2012 | Kuijpers et al. | 345/690 |

* cited by examiner

*Primary Examiner* — Don Le
(74) *Attorney, Agent, or Firm* — Robert L. McKellar; McKellar IP Law, PLLC

(57) ABSTRACT

A method of creating a light effect using the concurrent exposure of a variety of colored designs to at least two different colored light emitting diode lights and controlling the light emitting diode lights.

5 Claims, 2 Drawing Sheets

METHOD OF CREATING A LIGHT EFFECT

This invention deals with a method of creating a light effect using the concurrent exposure of a variety of colored designs to at least two different colored light emitting diode lights and controlling the light emitting diode lights.

BACKGROUND OF THE INVENTION

There are in the United States, areas of closed recreation such as game parlors, bowling establishments, computer cafes and the like in which people find entertainment.

As part of the entertainment, these closed recreation areas provide specific games, or other personal devices for people wishing to entertain themselves and these closed areas are festive, in that, they are quite often provided with colored lights, movies or other graphic components, decorations and the like.

Specifically, in bowling establishments, it is quite often the case that the walls at the distal ends of the bowling lanes are provided with murals, scenes, landscapes, pictures, illustrations and the like as pictorials. These take the form of being painted on the walls, painted or printed panels of various solid substrates containing various scenes or landscapes, or fabric or flexible banners, and the like.

These pictorials are static in nature, that is they are painted on the walls, or wallpapered, or the like, and sometimes, these pictorials are enhanced with spotlights, or other incandescent lamps, to highlight them.

One most notable example of more modern pictorials is the use of fluorescent painted or printed pictorials and the use of black light. Evenso, the perception to the human eye of the effects produced by the prior art methods, is a static perception.

THE INVENTION

Thus what is disclosed and claimed herein is a method of creating a light effect, wherein the effect provides perceived moving images or color changes to the human eye. The method comprises concurrently exposing a variety of colored designs to at least two different colors of light emitting diode lights. The light emitting diodes are controlled according to a pre-determined strategy to provide a desired light effect selected such as movement and/or complete change of image colors in the designs.

DETAILED DESCRIPTION OF THE INVENTION

As used herein, the term light emitting diode (LED) means any system that is capable of receiving an electrical signal and producing a color of light in response to the signal. One such example of an LED is Chauvet LED color banks available from Chauvet Lighting, located in Hollywood, Fla., that can be controlled with any dmx-512 controller also sold by Chauvet Lighting.

For purposes of this invention the light emitting diode banks of lights can have a configuration selected from linear, vertical, horizontal, circular, angular, elliptical, and combinations of them. The lights can be colored or white.

Essentially, the controller is programmed or pre-programmed to perform a series of light changes desired by those using the system. Such programs are controlled by a computer, and such computer programs are known to those skilled in the art such as the dmx-512 controller discussed Supra, and its accompanying software.

In the inventive method, by exposing a variety of colored images/designs to varying LED colors or a combination of LED colored lights, the effect of movement and/or a complete change of image colors can be achieved.

Moreover, this can be achieved without using fluorescent or any other special pigmented inks and standard printing inks can be used. It is known that the special inks are susceptible to degradation after only a short period of time while standard inks or pigments have long term lives.

Figure 1:
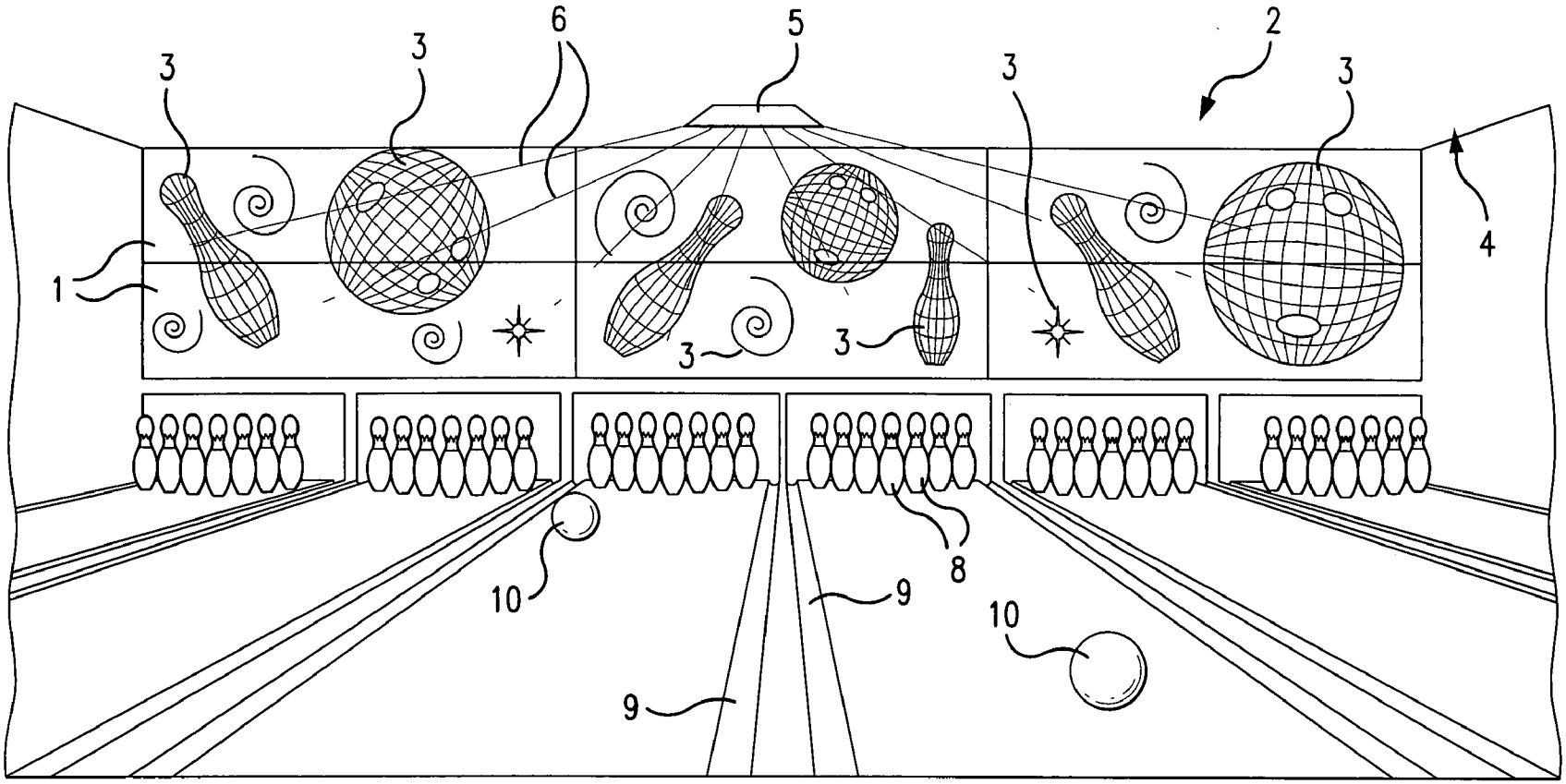
FIG. 1 is a full perspective view of the inside of a bowling alley looking from back to front.

Turning now to FIG. 1, there is shown a panoramic view of the inside of a bowling alley in which there are shown six panels 1 located at the front end 2 of a bowling alley. For illustration purposes, there is shown various images 3 on the panels. Located at or near the ceiling 4 is a bank of LEDs 5, wherein the computer for controlling this bank 5 is located out of view.

The combined array of LED's of the bank 5 form a beam or stream of light 6 that impinges on the images 3. Because of the changing color and orientation of the LEDs, the human eye perceives movement or color change of the images.

Figure 2:
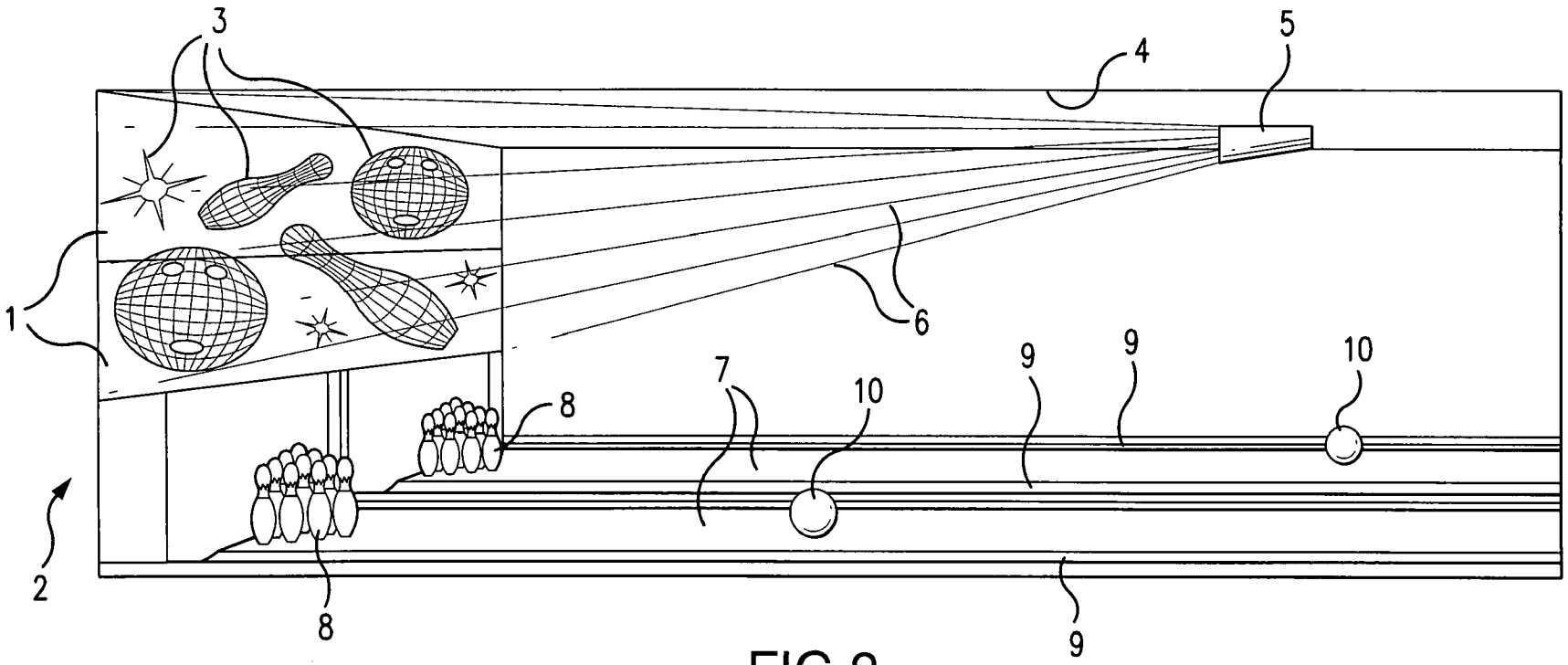
FIG. 2 is a full side view of the view of FIG. 1, including only two bowling lanes.

FIG. 2 shows a full side view of FIG. 1, wherein there is shown the images 3, the bank 5, and the stream of light 6.

Not part of the invention, but also shown for perspective, is the bowling operation, for example, the bowling lanes 7, the bowling pins 8 and the ball returns 9, and the bowling balls 10.

It is contemplated with the scope of this invention to use this method for all varieties of applications, such as bowling establishments, game parlors, mirror or glass mazes, and the like.

What is claimed is:

1. A method of creating a light effect, said effect providing perceived moving images to the human eye, said method comprising:

i. concurrently exposing a variety of colored designs to at least two different colors of light emitting diode lights;

ii controlling said light emitting diode lights to provide a desired light effect selected from the group consisting of i movement, and, ii complete change of image colors in the designs.

2. The method as claimed in claim 1 wherein the venue for the use of the method is a bowling establishment.

3. The method as claimed in claim 1 wherein the venue for the use of the method is a game parlors.

4. The method as claimed in claim 1 wherein the method is used in an indoor mirror maze house.

5. The method as claimed in claim 1 wherein the method is used in a glass maze house.

* * * * *